US007891197B2

(12) United States Patent
Winter

(10) Patent No.: US 7,891,197 B2
(45) Date of Patent: Feb. 22, 2011

(54) METHOD FOR NON-INTERMITTENT PROVISION OF FLUID SUPERCOOL CARBON DIOXIDE AT CONSTANT PRESSURE ABOVE 40 BAR AS WELL AS THE SYSTEM FOR IMPLEMENTATION OF THE METHOD

(75) Inventor: Harald Winter, Munchengladbach (DE)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 10/504,122

(22) PCT Filed: Feb. 5, 2003

(86) PCT No.: PCT/EP03/01832

§ 371 (c)(1),
(2), (4) Date: Aug. 6, 2004

(87) PCT Pub. No.: WO03/067144

PCT Pub. Date: Aug. 14, 2003

(65) Prior Publication Data

US 2005/0126188 A1 Jun. 16, 2005

(30) Foreign Application Priority Data

Feb. 7, 2002 (DE) ..... 102 05 130

(51) Int. Cl.
*F17C 7/02* (2006.01)

(52) U.S. Cl. ..... 62/50.1; 62/50.4

(58) Field of Classification Search ..... 62/50.1, 62/50.2, 50.4, 53.2; 141/82, 39, 328, 18
See application file for complete search history.

(56) References Cited

U.S. PATENT DOCUMENTS 2,487,863 A 7/1946 Garretson
3,672,181 A * 6/1972 Tyree, Jr. ..... 62/63
4,127,008 A * 11/1978 Tyree, Jr. ..... 62/62
5,088,436 A * 2/1992 Stritmatter ..... 141/234

(Continued)

FOREIGN PATENT DOCUMENTS

EP 0340545 A2 * 11/1989

(Continued)

OTHER PUBLICATIONS

International Search Report for PCT/EP 03/01832.

*Primary Examiner*—Mohammad M Ali
(74) *Attorney, Agent, or Firm*—Christopher J. Cronin

(57) ABSTRACT

A method and an apparatus for the uninterrupted supply of liquid subcooled carbon dioxide. The liquid is supplied at a nearly constant pressure greater than about 40 bar. Liquid carbon dioxide is supplied at a low pressure and is sent into a low pressure tank where it is stored temporarily. The carbon dioxide is then pumped, with a pump, from the low pressure tank to a high pressure tank. During the pumping, the pressure of the carbon dioxide is increased. The carbon dioxide is stored in the high pressure tank until its removal. When the carbon dioxide is removed, it is in a thermodynamic disequilibrium between the liquid and gas phases.

19 Claims, 1 Drawing Sheet

U.S. PATENT DOCUMENTS 5,121,609 A * 6/1992 Cieslukowski ..... 62/50.4
5,127,230 A * 7/1992 Neeser et al. ..... 62/7
5,231,838 A * 8/1993 Cieslukowski ..... 62/50.4
5,325,894 A * 7/1994 Kooy et al. ..... 141/4
5,360,139 A * 11/1994 Goode ..... 222/40
5,373,702 A 12/1994 Kalet et al.
5,409,046 A 4/1995 Swenson et al.
5,415,001 A * 5/1995 Powars ..... 62/50.2
5,510,019 A * 4/1996 Yabumoto et al. ..... 210/137
5,537,824 A * 7/1996 Gustafson et al. ..... 62/7
5,554,382 A * 9/1996 Castor ..... 424/450
5,764,716 A * 6/1998 Eckardt ..... 376/279
5,771,946 A 6/1998 Kooy et al.
5,937,655 A * 8/1999 Weiler et al. ..... 62/50.1
5,993,761 A * 11/1999 Czernichowski et al. .... 423/210
6,182,717 B1 * 2/2001 Yamashita ..... 141/82
6,354,088 B1 * 3/2002 Emmer et al. ..... 62/50.1
6,581,390 B2 * 6/2003 Emmer et al. ..... 62/50.6
6,691,430 B2 * 2/2004 Saito et al. ..... 34/389

FOREIGN PATENT DOCUMENTS

WO WO 99/38762 * 8/1999

* cited by examiner

Fig. 1
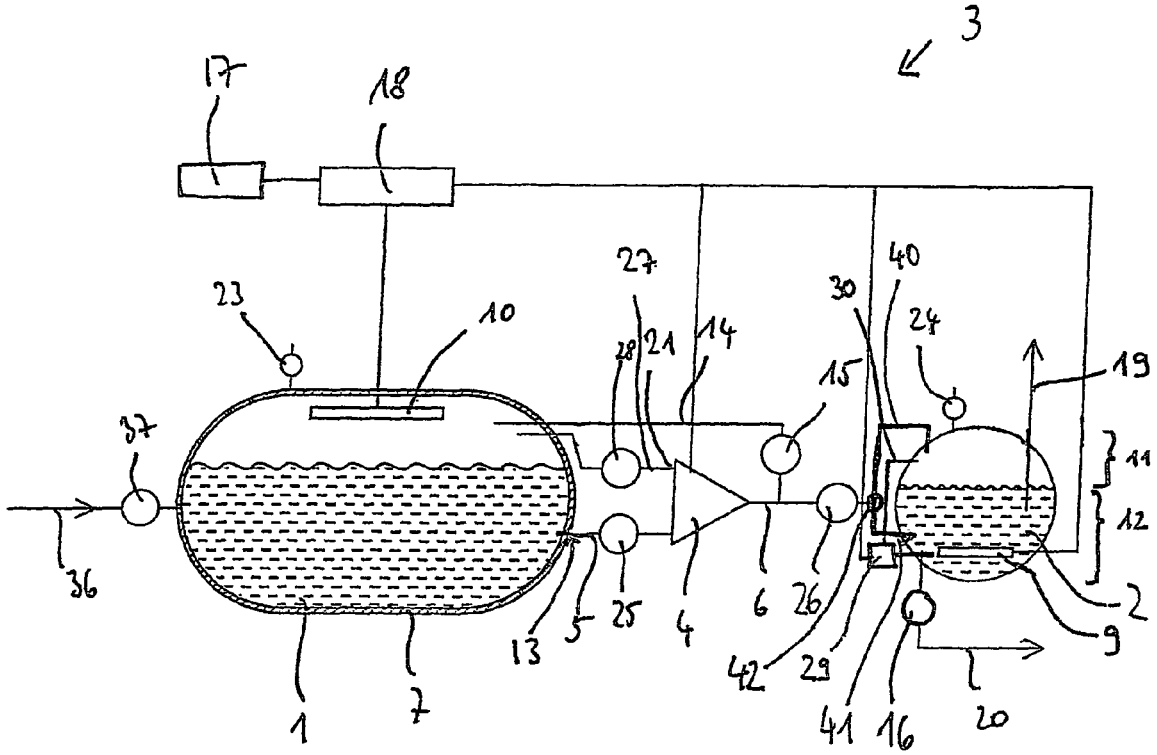
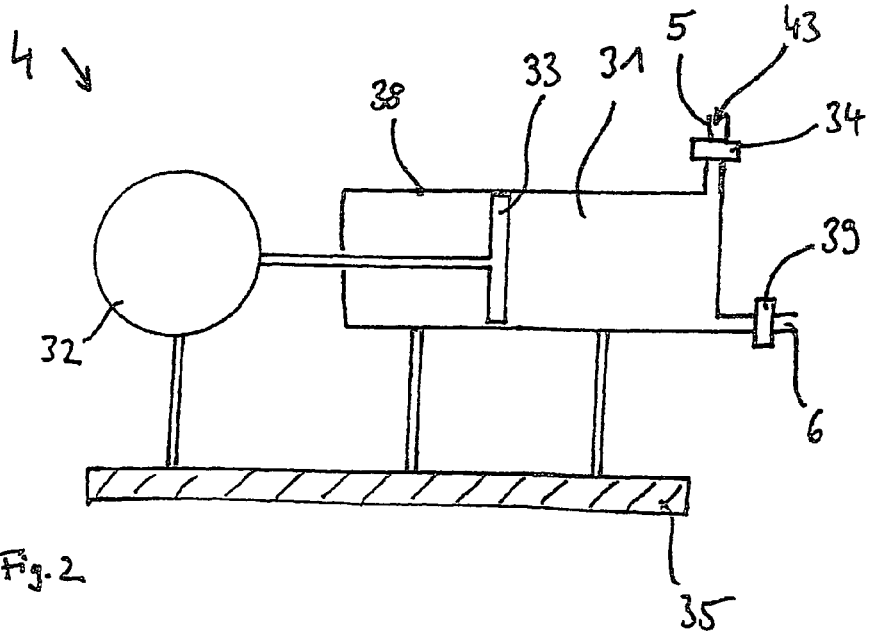
Fig. 2

METHOD FOR NON-INTERMITTENT PROVISION OF FLUID SUPERCOOL CARBON DIOXIDE AT CONSTANT PRESSURE ABOVE 40 BAR AS WELL AS THE SYSTEM FOR IMPLEMENTATION OF THE METHOD

BACKGROUND

The invention relates to a process and a supply system for the uninterrupted provision of liquid subcooled carbon dioxide at an essentially constant pressure greater than 40 bar.

In certain applications, large amounts of carbon dioxide at high pressure are required. An important aspect in this case is that the pressure is to be provided in as constant a manner as possible and the amount of carbon dioxide transported must be metered as accurately as possible.

Recently carbon dioxide uses are being established, for example, which require carbon dioxide at about 60 bar or above. For example, liquid carbon dioxide at 60 bar is required for foaming plastics, in supercritical extraction, in chilling, in plasma spraying using laminar nozzles or in charging small carbon dioxide vessels.

In the production of polystyrene foam (XPS) by the mechanical blowing process, the blowing agent carbon dioxide used as an alternative is forced into the foam extruder at up to about 350 bar using a diaphragm metering pump system. For the high pressure pumps, some manufacturers prescribe the use of room-temperature carbon dioxide which must be stored at a constant pressure and subcooled before entry into the metering pump.

To date, to provide liquid carbon dioxide at high pressure, a stationary high-pressure tank has been filled with cold carbon dioxide at low pressure (up to 20 bar). The carbon dioxide was then warmed, as a result of which the pressure in the high-pressure tank increased to the desired minimum pressure. During replenishment, the pressure had to be decreased back to the low pressure level. The pressure was decreased by releasing gaseous carbon dioxide from the high-pressure tank, which gave rise to costs and generally represented noise pollution for the environment. Furthermore, the supply with carbon dioxide was interrupted during the charging period. In order to avoid interruption of the carbon dioxide supply, two high-pressure tanks had to be mounted which were alternately charged and emptied. Not only the procurement costs of the two high-pressure vessels but also their maintenance costs due to the blow-off were considerable.

High-pressure storage in non-insulated heatable pressure vessels at 60 bar and 22° C. is not able to continuously ensure high-pressure conditions. Since tanker trucks for industrial scale carbon dioxide consumption always provide low-temperature low-pressure carbon dioxide (12 bar/−35° C.), the pressure in a high-pressure vessel collapses during replenishment. The supply pressure of the carbon dioxide must be elevated to the desired pressure level by an internal vessel heater having an output-dependent time delay.

Charging high-pressure carbon dioxide vessels using the customary tanker truck pumps also posed problems, so that the pressure in the vessels had to be released before charging to the maximum possible pump pressure.

Storage of low-temperature liquid carbon dioxide in a low-pressure tank and supplying a plant with liquid carbon dioxide at high pressure using a pump has the disadvantage that in the event of pump faults, supply of the plant with carbon dioxide is interrupted and thus gives rise to considerable costs.

It was also disadvantageous with known processes that carbon dioxide was always provided in a state close to its boiling point. Liquids close to their boiling point have a tendency to vapour formation, which makes metering more difficult and makes transport relatively energy-intensive owing to the compression losses which occur.

It is an object of the present invention, therefore, to specify an improved process and a supply system by which liquid carbon dioxide can be provided uninterruptedly and inexpensively at an essentially constant pressure greater than 40 bar.

SUMMARY

This object is achieved according to the invention by a process and an apparatus as described herein. Advantageous embodiments and developments each of which can be employed individually or can be combined as desired with one another are subject matter of the respective dependent claims.

The inventive process for the uninterrupted provision of liquid subcooled carbon dioxide at essentially constant pressure greater than 40 bar comprises the following process steps:

- the liquid carbon dioxide is supplied at low pressure;
- the carbon dioxide is charged into a low-pressure tank and is there stored temporarily;
- the carbon dioxide is pumped by means of a pump from the low-pressure tank into a high-pressure tank, the pressure of the carbon dioxide being increased;
- the carbon dioxide is stored or temporarily stored in the high-pressure tank until removal in a thermodynamic disequilibrium between a liquid phase and a gas phase.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein:

FIG. 1 illustrates diagrammatically an inventive supply system; and

FIG. 2 illustrates diagrammatically a piston pump used in the inventive supply system according to the embodiment of FIG. 1.

DESCRIPTION OF PREFERRED EMBODIMENTS

This object is achieved according to the invention by a process and an apparatus as described herein. Advantageous embodiments and developments each of which can be employed individually or can be combined as desired with one another are subject matter of the respective dependent claims.

The inventive process for the uninterrupted provision of liquid subcooled carbon dioxide at essentially constant pressure greater than 40 bar comprises the following process steps:

- the liquid carbon dioxide is supplied at low pressure;
- the carbon dioxide is charged into a low-pressure tank and is there stored temporarily;
- the carbon dioxide is pumped by means of a pump from the low-pressure tank into a high-pressure tank, the pressure of the carbon dioxide being increased; and the carbon dioxide is stored or temporarily stored in the high-pressure tank until removal in a thermodynamic disequilibrium between a liquid phase and a gas phase.

The double temporary storage of the carbon dioxide permits uninterrupted provision of carbon dioxide. If faults in the plant occur, in particular in the pump, the amount of carbon dioxide present in the high-pressure tank can be used for the supply until the plant is repaired. The high-pressure tank has the function of a buffer reservoir.

Carbon dioxide in thermodynamic equilibrium begins to boil rapidly in the case of small temperature decreases or temperature increases. The intermediate storage of the carbon dioxide in thermodynamic disequilibrium permits provision of subcooled carbon dioxide which does not exhibit this disadvantage in the known manner. The carbon dioxide does not form bubbles and is thus more easily transported and metered. Thermodynamic disequilibrium here means that the temperature of the liquid carbon dioxide is lower than the equilibrium temperature which is given by the prevailing pressure and the vapour-pressure curve. This thermodynamic disequilibrium occurs as a result of a nonhomogeneous temperature distribution in the high-pressure tank, in particular as result of a temperature gradient between the gaseous phase and the liquid phase of the carbon dioxide in the high-pressure tank. If the temperature of the gaseous phase is higher than that of the liquid phase, a subcooled liquid is present.

The great advantage of the inventive process is that conditioned carbon dioxide can be provided. In particular, the conditioned carbon dioxide is readily pumpable, does not have a tendency to (micro)bubble formation, is present at a constant pressure and is provided uninterruptedly with great reliability. Costs of subsequent conditioning of the carbon dioxide are at least in part avoided. The operation of such a process is comparatively inexpensive.

The high-pressure tank is designed in such a way that pressures between 40 and 80 bar can be accepted. For this, the high-pressure tank is expediently designed as a spherical vessel which has in particular thermal insulation, preferably a PU foam insulation, having a metal jacket of aluminium or galvanized steel. Since many applications require liquid carbon dioxide at high pressure, the high-pressure tank exhibits the coexistence of a liquid phase and a gaseous phase of the carbon dioxide. However, in principle, the high-pressure tank can also be operated in the supercritical range, that is to say at above 73.7 bar. At pressures higher than 73.7 bar, the carbon dioxide is present in thermodynamic equilibrium in a single homogeneous phase which can be considered a high-density gas phase.

The low-pressure tank is designed for lower pressures, in particular for pressures less than 40 bar, in particular less than 30 bar, preferably less than 25 bar. The low-pressure tank need not be designed as a spherical vessel and can be horizontal or vertical. Advantageously it has a pressure-build-up device and a connection for carbon dioxide in the liquid phase. The low-pressure tank has thermal insulation, in particular vacuum insulation. The low-pressure tank can be charged from conventional carbon dioxide tanker trucks. In the low-pressure tank a liquid phase and a gaseous phase of the carbon dioxide coexist in thermodynamic equilibrium.

By means of the pump the pressure of the carbon dioxide is increased from the lower level of the low-pressure tank to the higher level of the high-pressure tank. As soon as the quantity or mass of carbon dioxide in the high-pressure tank exceeds a preset value, liquid carbon dioxide is pumped from the low-pressure tank into the high-pressure tank. This ensures that the high-pressure tank constantly has a sufficient amount of carbon dioxide, in particular two thirds, preferably three quarters, of a maximum capacity. This ensures that even with short-term faults of the system, in particular the pump, sufficient liquid carbon dioxide is still present for supply. The pump ensures a pressure gradient between the high-pressure tank and the low-pressure tank.

As a result of the double temporary storage of the carbon dioxide, the temporary storage at a lower pressure level and the storage at a higher pressure level, uninterrupted provision of liquid carbon dioxide is made possible. In particular, the carbon dioxide can be delivered at a low pressure in a simple manner using a conventional tanker truck, without an interruption in the supply with carbon dioxide at high pressure taking place.

In an embodiment of the inventive process, carbon dioxide from the liquid phase from the low-pressure tank is introduced into the liquid phase in the high-pressure tank to build up pressure in the high-pressure tank. By adding the liquid carbon dioxide directly to the liquid phase in the high-pressure tank the temperature of the gaseous carbon dioxide in the high-pressure tank is essentially unchanged. The increase in the volume fraction of the liquid phase in the high-pressure tank caused by the addition produces a compression of the gaseous phase in the high-pressure tank, which increases the pressure in the high-pressure tank.

In a further embodiment of the inventive process, the liquid carbon dioxide from the low-pressure tank is introduced into the gas phase in the high-pressure tank to decrease the pressure in the high-pressure tank. As a result of adding the cold liquid carbon dioxide from the low-pressure tank to the gaseous phase of the carbon dioxide in the high-pressure tank, a partial liquefaction of the gaseous carbon dioxide takes place. As result the pressure in the high-pressure tank decreases.

Advantageously, the pressure of the carbon dioxide in the high-pressure tank is controlled by means of the fact that liquid carbon dioxide, depending on the current pressure in the high-pressure tank, is fed either to the gas phase or the liquid phase in the high-pressure tank. Depending on whether the pressure in the high-pressure tank is too low or too high, the pressure in the high-pressure tank can be kept constant either by feeding liquid carbon dioxide directly to the liquid phase of the carbon dioxide in the high-pressure tank, or by adding liquid carbon dioxide to the gaseous phase of the carbon dioxide, for example by spraying it into the gaseous phase.

In a further embodiment of the invention, the temperature of the liquid phase in the high-pressure tank is between 0 and 10° C., preferably between 2 and 5° C. These temperatures, at a pressure of around 60 bar, do not correspond to the temperature according to the equilibrium vapour pressure curve. The liquid is thus a subcooled liquid. The temperature arises owing to a thermodynamic disequilibrium. This disequilibrium is caused by a nonhomogeneous temperature distribution between liquid phase and gas phase. Subcooled liquid carbon dioxide has the advantage that it does not have a tendency to vaporize and is readily pumpable.

Since many applications require liquid subcooled carbon dioxide, a thermodynamic disequilibrium must be produced or maintained in the high-pressure tank. To produce or maintain the disequilibrium, according to the invention the liquid phase in the high-pressure tank is warmed locally at one point, vaporized and/or converted into the gaseous phase. Expediently, the disequilibrium can be produced or maintained by local heating of gaseous carbon dioxide and/or by vaporizing liquid carbon dioxide and/or by adding cold liquid carbon dioxide from the low-pressure tank to the high-pressure tank. The local heating causes a stabilization of the pressure in the high-pressure tank. Liquid carbon dioxide is thus provided at a temperature which is lower than that corresponding to the vapour pressure curve.

Choosing an appropriate level of heating output in the local heating compensates for the loss of gaseous carbon dioxide owing to condensation of gaseous carbon dioxide. Also, proper choice of heating output compensates for the pressure drop in the high-pressure tank owing to take-off of liquid carbon dioxide.

For further pressure stabilization and to ensure a minimum pressure in the high-pressure tank, in particular during replenishment with cold carbon dioxide from the low-pressure tank, the liquid phase and/or the gas phase in the high-pressure tank is warmed. The warming is performed, in particular, by separate heating systems.

If, for example, cold carbon dioxide from the low-pressure tank is fed to the high-pressure tank via the gas phase, the temperature of the liquid carbon dioxide in the high-pressure tank falls. As a result, gaseous carbon dioxide condenses in the high-pressure tank. The temperature decrease produces a fall in pressure in accordance with the vapour-pressure curve. To avoid such pressure fluctuations during charging, the liquid cold carbon dioxide fed is passed in a defined ratio both into the gas phase and the liquid phase of the high-pressure tank.

An excessive fall in temperature of the liquid phase in the high-pressure tank due to adding cold carbon dioxide from the low-pressure tank is prevented by a second heater. By means of the second heater, the subcooling of the carbon dioxide towards low temperatures is limited.

Advantageously, the carbon dioxide is fed from the low-pressure tank to the high-pressure tank as soon as the volume or mass of carbon dioxide in the high-pressure tank falls below a preset value. A suitable control circuit ensures by this means that sufficient liquid carbon dioxide is always present in the high-pressure tank. In particular in the event of pump faults or temporary restrictions in supplying the high-pressure tank with liquid carbon dioxide, this buffer ensures a safety period which can be utilized for remedying the fault. For example, the high-pressure tank is filled with liquid carbon dioxide as soon as the high-pressure tank is less than three-quarters full. In the event of a fault, thus at least the volume of a three-quarters-full high-pressure tank is available. This measure considerably increases the security of supply.

In one embodiment of the invention, the low pressure is less than 40 bar, in particular less than 30 bar, preferably less than 25 bar. At low pressures, transport using conventional tanker trucks is simpler and cheaper.

Advantageously, to ensure a minimum pressure in the low-pressure tank, the liquid carbon dioxide in the low-pressure tank is warmed. This also prevents solid carbon dioxide (dry ice) from forming in the low-pressure tank. In particular, when the pump withdraws relatively large amounts of carbon dioxide from the low-pressure tank and feeds them to the high-pressure tank, the pressure in the low-pressure tank decreases if insufficient liquid carbon dioxide vaporizes and passes over into the gas phase for pressure compensation.

When low-temperature carbon dioxide is fed to the low-pressure tank from a tanker truck, the pressure in the low-pressure tank also usually decreases, since with the addition of colder carbon dioxide the temperature in the low-pressure tank falls and the pressure follows the drop in temperature in accordance with the vapour-pressure curve. Heating the carbon dioxide causes a temperature elevation, by which means a pressure drop can be compensated for.

In one embodiment of the invention, to charge the pump with bubble-free carbon dioxide, the gaseous carbon dioxide formed in the first line and/or in the pump is recirculated to the low-pressure tank. The efficiency of the pump is thereby increased, since this avoids unnecessary compression of gaseous carbon dioxide.

The inventive supply system for uninterrupted provision of subcooled carbon dioxide at an essentially constant pressure greater than 40 bar comprises a low-pressure tank and a high-pressure tank, each for holding a liquid phase and a gas phase, and a pump, in which case the pump is disposed between the low-pressure tank and the high-pressure tank and is connected by a first line to the low-pressure tank and the pump is connected by a second line to the high-pressure tank. Advantageously, the second line transforms into an upper and lower feed line, the upper feed line opening out into an upper region of the high-pressure tank, and the lower feed line opening into a lower region of the high-pressure feed tank.

Via the first line, the pump and the upper or lower feed line, the low-pressure tank and the high-pressure tank are connected to one another. The pump produces the pressure difference between the pressure levels in the two tanks.

Liquid carbon dioxide is fed from the low-pressure tank to the high-pressure tank from the top via the upper feed line. Liquid carbon dioxide thus falls through the gas phase in the high-pressure tank, as result of which gaseous carbon dioxide is condensed. This causes the pressure to fall in the high-pressure tank.

Liquid carbon dioxide is fed from the low-pressure tank via the lower feed line to the liquid carbon dioxide in the high-pressure tank. As a result the volume of the liquid phase in the high-pressure tank increases, whereby the gaseous phase is compressed. This causes the pressure in the high-pressure tank to increase.

In a particular embodiment of the inventive supply system, the high-pressure tank has a first heater which is disposed in an additional line on the high-pressure tank, which line joins a lower region of the high-pressure tank for the liquid phase to a higher region of the high-pressure tank for the gas phase.

Using the first heater, liquid carbon dioxide is vaporized locally at one point to produce a minimum pressure in the high-pressure tank. A thermodynamic disequilibrium is hereby produced or maintained. The local heating of carbon dioxide at one point, with the thermodynamic disequilibrium being maintained, compensates for the rate of condensation of the carbon dioxide condensing from the gas phase by the rate of vaporization of the carbon dioxide passing from the liquid phase to the gaseous phase.

By means of the interaction of the warming by the first heater and the cooling by an addition of cold carbon dioxide from the low-pressure tank, subcooled liquid carbon dioxide is provided by the high-pressure tank at a high pressure and presettable temperature. This saves, at least in part, considerable costs for conditioning the carbon dioxide.

The upper feed line advantageously opens into an upper region of the high-pressure tank. If the liquid carbon dioxide is passed from the low-pressure tank to the high-pressure tank through the upper region of the high-pressure tank containing the gas phase, the temperature distribution in the high-pressure tank becomes homogeneous. The homogeneity of the temperature distribution can in turn be altered by targeted local heating of the gaseous and/or the liquid phase. The interaction between homogeneity and nonhomogeneity is used, in the context of control, for providing conditioned, that is to say liquid and subcooled, carbon dioxide at a constantly high pressure.

By controlling the timely supply of the high-pressure tank with carbon dioxide from the low-pressure tank, the security of supply is considerably increased. Even technical faults of the pump do not inevitably lead to an interruption in supply with carbon dioxide, since a large amount of liquid carbon dioxide is present to maintain the carbon dioxide supply during the time of repair or replacement of the pump.

For further support of a minimum pressure in the high-pressure tank, and also to ensure a minimum temperature in the high-pressure tank, the high-pressure tank has a second heater which is disposed in the lower region of the high-pressure tank. If, for example, the temperature of the liquid carbon dioxide in the high-pressure tank falls below a preset value owing to the addition of cold carbon dioxide from the low-pressure tank, the temperature can be increased by the second heater. Using the second heater, a temperature difference between the liquid and gaseous phases in the high-pressure tank can be levelled out.

Since the low-pressure tank has a low pressure less than 40 bar, in particular less than 30 bar, preferably less than 25 bar, the low pressure tank can be charged by conventional tanker trucks for carbon dioxide. In order that the low-pressure tank can store cold carbon dioxide, in particular carbon dioxide at less than −10° C., the low-pressure tank has thermal insulation. In a special embodiment of the invention, the low-pressure tank has a pressure build-up device, by which means the pressure in the low-pressure tank can be built up.

The high-pressure tank is constructed in such a manner that it can accept pressures which are required by the respective application. The high-pressure tank can withstand pressures of at least 40 bar, in particular at least 50 bar, preferably at least 60 bar. In order that the high-pressure tank can hold subcooled liquid carbon dioxide, the high-pressure tank is expediently thermally insulated.

To counteract a general warming of the carbon dioxide in the low-pressure tank, the low-pressure tank has a cooler. This prevents excessive pressure increase in the low-pressure tank.

A minimum temperature in the low-pressure tank, in particular when low-temperature carbon dioxide is added from a tanker truck, is ensured by heating by means of a further heater for the liquid carbon dioxide phase. Even in the event of high takeoff of liquid carbon dioxide from the low-pressure tank by the high-pressure tank, by heating using this heater, sufficient liquid carbon dioxide is vaporized and converted into the gas phase to counteract a pressure drop in the low-pressure tank.

In order to transport the carbon dioxide from the low-pressure tank to the high-pressure tank efficiently, the low-pressure tank has a connection for the liquid phase for the first line. Large amounts of carbon dioxide may be transported better using a pump with a compressor, since a compressor to a great degree only performs work on the gas, which increases the internal energy of the gas. This portion of the work expended is lost as heat and is not used for the actual pumping of the carbon dioxide.

In a special embodiment, a return line is provided between the second line and the low-pressure tank, by means of which return line gaseous carbon dioxide can be recirculated to the low-pressure tank. This is important in particular when turning on the pump, if much gaseous carbon dioxide is formed during cooling of the pumps.

For open-loop or closed-loop control of the supply system, an instrumentation system having sensors is provided that determines at least one parameter selected from the group consisting of quantity of carbon dioxide or mass of carbon dioxide in the high-pressure tank, quantity of carbon dioxide or mass of carbon dioxide in the low-pressure tank, pressure in the high-pressure tank, pressure in the low-pressure tank, temperature of the liquid phase in the high-pressure tank, temperature of the carbon dioxide in the low-pressure tank and temperature of the pump.

Determining the carbon quantity in the high-pressure tank., for example by carbon dioxide mass determination establishes when replenishment of the high-pressure tank by carbon dioxide from the low-pressure tank using the pump is necessary.

By determining the carbon dioxide quantity or carbon dioxide mass in the low-pressure tank, delivery dates are established for new carbon dioxide from a tanker truck.

The pressure in the high-pressure tank and in the low-pressure tank is measured in order to, firstly, prevent excessive overpressure in the high-pressure tank, and secondly to recognize faults in the operation of the supply system. In particular for applications which necessitate a particularly constant high pressure, pressure monitoring in the high-pressure tank is required.

With the aid of measuring the temperature of the liquid carbon dioxide in the high-pressure tank, a minimum temperature required for many applications is ensured. If the temperature falls below a preset value, heating is performed. Temperature measurement is also necessary in order to ensure that a maximum temperature of the carbon dioxide in the high-pressure is not exceeded.

Measuring the temperature of the carbon dioxide in the low-pressure tank and of the pump is expedient for checking the status of the supply system.

Advantageously, the supply system comprises a control unit which is connected to the instrumentation system and at least one component selected from the group consisting of pump, second heater for the liquid phase in the high-pressure tank, first heater for the liquid phase in the high-pressure tank, cooler in the low-pressure tank, first valve in the first line, second valve in the second line, third valve in the second line, return line valve in the return line between the second line and the low-pressure tank, first safety valve on the low-pressure tank and second safety valve on the high-pressure tank.

By means of the control unit and the pump, a sufficient liquid level in the high-pressure tank, for example, is ensured.

By means of the second heater for liquid carbon dioxide in the high-pressure tank, a minimum temperature of the liquid carbon dioxide in the high-pressure tank is ensured.

Using the first heater, liquid carbon dioxide is vaporized locally at one point in the high-pressure tank, which builds up and maintains a thermodynamic disequilibrium in the high-pressure tank.

Controlling the cooling ensures that a maximum temperature, and thus a maximum pressure, in the low-pressure tank is not exceeded.

Using the first valve, at times when the pump is not required, the pump can be decoupled from the low-pressure tank, so that stressing the pump with low temperatures is avoided.

Using the second valve, for the period when the pump is not in operation, the pump is decoupled from the high-pressure tank.

Using the third valve in the second line, the cold liquid carbon-dioxide stream is either passed directly into the liquid carbon dioxide in the high-pressure tank, whereby the pressure in the high-pressure tank is increased, or is passed into the gas phase of the high-pressure tank, whereby the pressure is reduced.

By means of the return line valve in the return line between the second line and the low-pressure tank, gaseous carbon dioxide can be recirculated in a controlled manner into the low-pressure tank. This is important, in particular, when, on turning on the pump, liquid carbon dioxide is vaporized during cooling of the pump. Pumping gaseous carbon dioxide is energy-consuming and endangers the functionality of the high-pressure pump.

Controlling the first safety valve on the low-pressure tank and the second safety valve on the high-pressure tank prevents the low-pressure tank or the high-pressure tank from being excessively loaded.

In an advantageous embodiment of the inventive supply system, to take off the carbon dioxide from the liquid phase, the high-pressure tank has a dewatering valve and/or a descender tube. By means of the dewatering valve and/or the descender tube, the liquid phase of the carbon dioxide is taken off from the high-pressure tank in a simple manner.

Advantageously, the pump is a piston pump having a displacement space, in particular a three-piston pump, which is arranged and/or constructed in such a manner that gas cannot collect in the suction space during operation. Thus, gas collection in the displacement space is largely prevented.

Collections of gas in the displacement space lead to high energy losses, since the work applied by the pump is not used for pumping the liquid carbon dioxide, but for compressing the gaseous phase of the carbon dioxide. This leads only to increasing the internal energy of the carbon dioxide, in particular to elevating its temperature, and is energy-consuming.

By means of a suitable arrangement of the control valves, the displacement space of the piston pump is always filled with liquid carbon dioxide. Gaseous carbon dioxide can escape from the suction space; collection of gaseous carbon dioxide is avoided.

Additional degassing orifices or channels which lead off gaseous carbon dioxide from the displacement space, in particular to the low-pressure tank, are expedient in order to ensure that the displacement space is always filled solely with liquid carbon dioxide.

Advantageously, to remove the gaseous phase from the suction space, a takeoff line is present between an inlet of a pump and an upper part of the low-pressure tank. Gaseous carbon dioxide thus escapes from the suction space of the piston pump and passes via the takeoff line to the low-pressure tank.

In a special embodiment of the inventive supply system, the high-pressure tank has a capacity of less than 2 t, in particular less than 1.5 t, preferably less than 1.2 t, of carbon dioxide.

Compared with high-pressure tanks which are customary for industrial scale applications, a high-pressure tank of the inventive supply system is small. Such small high-pressure tanks are inexpensive and, owing to the interaction between low-pressure tank and high-pressure tank, are completely sufficient to provide an uninterrupted continuous flow of carbon dioxide in large quantities.

The low-pressure tank advantageously has a capacity of at least 3 t, in particular at least 7 t, preferably at least 10 t, of carbon dioxide. As a result of such a large dimensioning of the low-pressure tank, a sufficiently large quantity of carbon dioxide is stored temporarily for a high carbon dioxide consumption in corresponding industrial scale applications, so that the supply system is comparatively independent of short-term supply restrictions during delivery of carbon dioxide from tanker trucks.

Further advantageous embodiments are described with reference to the drawing below. The drawing is not intended to restrict the scope of the invention, but only to illustrate this by way of examples.

In the drawing:

FIG. 1 shows diagrammatically an inventive supply system and

FIG. 2 shows diagrammatically a piston pump used in the inventive supply system according to FIG. 1.

FIG. 1 shows an inventive supply system 3 having a low-pressure tank 1 and a high-pressure tank 2 in which in each case liquid and gaseous carbon dioxide are present as coexisting phases. The low-pressure tank 1 is connected via a first line 5 to a pump 4 and, via a second line 6 or an upper feed line 40 and a lower feed line 41, from the pump 4 to the high-pressure tank 2.

By means of a first valve 25 in the first line 5 and a second valve 26 in the second line 6, the pump 4 can be decoupled from the low-pressure tank 1 and the high-pressure tank 2 when the pump 4 is not in operation or must be serviced. Via an inlet tube 36 having an inlet valve 37, the low-pressure tank 1 is charged from a tanker truck with cold liquid carbon dioxide at −35° C. and 15 bar.

To restrict the pressure in the low-pressure tank, the carbon dioxide is stabilized in temperature by an insulation 7, in that the insulation 7 decreases heat flux from the outside to the carbon dioxide in the low-pressure tank. The cooler 10 has the task of counteracting a warming of the carbon dioxide due to a heat flux from the outside. A safety valve 23 ensures that in the event of excessive temperature increase a maximum permissible maximum pressure is not exceeded. If the pressure reaches this maximum pressure, gaseous carbon dioxide is discharged, as a result of which the temperature of the liquid carbon dioxide falls owing to the heat of evaporation of the liquid carbon dioxide.

The pump 4 takes off liquid carbon dioxide from the low-pressure tank 1 at a liquid port 13. If so much liquid carbon dioxide is taken off from the low-pressure tank 1 that the pressure in the low-pressure tank 1 falls excessively, which would cause a decrease in temperature of the carbon dioxide in the low-pressure tank 1, or if too much cold liquid carbon dioxide is charged into the low-pressure tank, the liquid phase in the low-pressure tank 1 is heated.

The pump 4 is constructed as a piston pump and has an inlet 21 which is joined to the low-pressure tank 1 via a return line 27 in which is disposed a return valve 28. By means of the return line 27, gaseous carbon dioxide which has formed either in the first line 5 or in the pump 4 is passed back to the low-pressure tank 1, so that the pump 4 is charged solely with liquid carbon dioxide and not also with gaseous carbon dioxide. By means of a return line 14 which has a return valve 15, during a cold start-up phase, liquid and/or gaseous carbon dioxide in the second line 6 is recirculated to the low-pressure tank 1 when the second valve 26 is closed. These measures prevent a considerable part of the work performed by the pump 4 from being lost by compression of the gaseous phase of the carbon dioxide being performed as a significant part of the work only to increase the internal energy of the carbon dioxide.

The high-pressure tank 2 has an upper region 11 for the gaseous phase of the carbon dioxide and a lower region 12 for the liquid phase of the carbon dioxide. The upper feed line 40 opens into the upper region 11 of the high-pressure tank 2. The lower feed line 41 opens into the lower region 12. Depending on the current pressure, a third valve 42 and a fourth valve pass the carbon dioxide stream into the high-pressure tank 2 via the upper feed line 40 or lower feed line 41. If carbon dioxide is fed via the upper feed line 40, the gas phase cools and the pressure in the high-pressure vessel decreases. If carbon dioxide is fed via the lower feed line 41, the gas phase above the liquid phase is compressed and the pressure in the high-pressure vessel increases.

As a result of addition of liquid carbon dioxide from the low-pressure tank 1, the temperature in the high-pressure tank 2 falls. The high-pressure tank 2 contains a first heater 29 for local heating and vaporization of liquid carbon dioxide in order to build up and maintain a thermodynamic disequilibrium.

By means of the different ways of feeding with the upper feed line 40 and lower feed line 41, and by means of the first heater 29, the subcooled state of the carbon dioxide is produced and maintained.

The high-pressure tank 2 has a second heater 9 for heating the liquid phase, which can be used to set a minimum temperature of the carbon dioxide.

If liquid carbon dioxide is taken off from the high-pressure tank 2 via a takeoff point 20 which has a dewatering valve 16, the pressure in the high-pressure tank 2 first decreases.

Using the first heater 29, liquid carbon dioxide can be converted into the gaseous phase, so that a thermodynamic disequilibrium is maintained in the high-pressure tank 2 at a constant pressure.

Subcooled liquid carbon dioxide is provided by means of the fact that the gaseous phase of the carbon dioxide is not in thermodynamic equilibrium with the liquid phase and the two phases have different temperatures.

However, on account of the vapour-pressure curve, a temperature difference leads to vaporization or condensation of carbon dioxide at the phase boundary. Especially in the case of subcooled carbon dioxide this leads to gaseous carbon dioxide condensing at the phase boundary and transferring to the liquid phase. This condensation and the associated loss of carbon dioxide in the gaseous phase leads to a pressure drop in the low-pressure tank 2 if sufficient liquid carbon dioxide is not fed to the gaseous phase via an additional line 30 for compensation using the first heater 29. Via choice of the heating output level of the first heater 29, a pressure drop in the high-pressure tank 2 can be prevented.

The second heater 9 has the task of ensuring a preset minimum temperature of the liquid phase in the high-pressure tank 2.

The heaters 9, 29 and the cooler 10 are connected by a control unit 18. The control unit 18 controls the heaters 9, 29, the cooler 10 and the pump 4 as a function of the data determined by an instrumentation system 17, for example the pressures, temperatures and liquid levels in the supply system 3.

A general warming of the carbon dioxide in the high-pressure tank 2 counteracts cooling as a result of the addition of cold carbon dioxide from the low-pressure tank 1. By suitable choice of the heater output levels in the high-pressure tank 2, and the carbon dioxide feed to the high-pressure tank 2, subcooled carbon dioxide is provided uninterruptedly at a constant pressure of about 60 bar.

A safety valve 24 protects the high-pressure tank 2 from an excessive overpressure.

The liquid carbon dioxide from the high-pressure tank can be taken off either via the takeoff point 20 or via a descender tube.

FIG. 2 shows a pump 4 used in the inventive supply system 3 having a drive 32 and a displacement space 31.

The suction valve is arranged in such a manner that only liquid carbon dioxide passes into the displacement space and as a result energy losses due to compression of gaseous carbon dioxide are avoided.

The inventive process for the uninterrupted provision of liquid subcooled carbon dioxide at essentially constant pressure greater than 40 bar comprises the following process steps: liquid carbon dioxide is delivered at a low pressure, the carbon dioxide is charged into a low-pressure tank 1 and stored there temporarily; the carbon dioxide is pumped from the low-pressure tank 1 to a high-pressure tank 2, the pressure of the carbon dioxide being increased and the carbon dioxide is stored temporarily in the high-pressure tank 2 in a thermodynamic disequilibrium until takeoff.

The process and the supply system 3 suitable for carrying out the process are distinguished by their high performance and efficiency for the uninterrupted and inexpensive supply of liquid subcooled carbon dioxide at essentially constant pressure greater than 40 bar.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

LIST OF DESIGNATIONS

1 Low-pressure tank
2 High-pressure tank
3 Supply system
4 Pump
5 First line
6 Second line
7 Insulation
9 Second heater
10 Cooler
11 Upper region
12 Lower region
13 Liquid port
14 Return line
15 Return line valve
16 Dewatering valve
17 Instrumentation system
18 Control unit
19 Gas displacement line
20 Takeoff point
21 Inlet
23 Safety valve
24 Safety valve
25 First valve
26 Second valve
27 Return line
28 Return line valve
29 First heater
30 Additional line
31 Displacement space
32 Drive
33 Piston
34 First valve
35 Support
36 Intake tube
37 Intake valve
38 Housing
39 Second valve
40 upper feed line
41 lower feed line
42 third valve
43 suction space

What is claimed is:

1. A method which may be used for the uninterrupted supply of liquid subcooled carbon dioxide at a nearly constant pressure of greater than about 40 bar, the method comprising:

a) supplying liquid carbon dioxide at low pressure;

b) introducing said low pressure liquid into a low pressure tank for temporary storage, said low pressure being less than 40 bar;

c) pumping said low pressure liquid, with a pump means, from said low pressure tank into a high pressure tank, wherein the pressure of said liquid is increased by said pumping;

d) storing said increased pressure liquid in said high pressure tank, wherein said increased pressure liquid is pumped into an upper region of said high pressure tank via an upper feed line or a lower region of said high pressure tank via a lower feed line depending upon a pressure in said high pressure tank; and e) removing said increased pressure liquid from said high pressure tank in a state of thermodynamic disequilibrium between the liquid and gas phases, the liquid phase in said high pressure tank is between about 0° C. and about 10° C.

2. The method of claim 1, wherein pressure is increased in said high pressure tank by adding said low pressure liquid from said low pressure tank to the liquid phase in said lower region of said high pressure tank.

3. The method of claim 1, wherein pressure is decreased in said high pressure tank by adding said low pressure liquid from said low pressure tank to the gas phase in said upper region of said high pressure tank.

4. The method of claim 1, further comprising controlling the pressure in said high pressure tank by adding said increased pressure liquid to at least one member selected from the group consisting of:

a) the gas phase in said high pressure tank; and b) the liquid phase in said high pressure tank.

5. The method of claim 1, wherein said temperature of said liquid phase in said high pressure tank is between about 2° C. and about 5° C.

6. The method of claim 1, further comprising producing said thermodynamic disequilibrium in said high pressure tank by locally warming the liquid phase in said high pressure tank to convert said liquid phase into the gas phase.

7. The method of claim 6, further comprising maintaining said thermodynamic disequilibrium in said high pressure tank by locally warming said liquid phase in said high pressure tank to convert said liquid phase into said gas phase.

8. The method of claim 1, further comprising stabilizing the pressure in said high pressure tank, wherein said stabilizing comprises warming at least one member selected from the group consisting of:

a) the liquid phase of said high pressure tank; and b) the gas phase of said high pressure tank.

9. The method of claim 8, wherein each said warming is performed by a separate heating system.

10. The method of claim 1, wherein said low pressure is less than about 30 bar.

11. The method of claim 10, wherein said low pressure is less than about 25 bar.

12. The method of claim 1, wherein additional low pressure liquid is pumped into said high pressure tank as soon as the quantity or mass of carbon dioxide in the high pressure tank exceeds a preset value.

13. A method which may be used for the uninterrupted supply of liquid subcooled carbon dioxide comprising:

a) supplying liquid carbon dioxide at low pressure;

b) introducing said low pressure liquid into a low pressure tank for temporary storage;

c) pumping said low pressure liquid, with a pump means, from said low pressure tank into a high pressure tank, wherein the pressure of said liquid is increased by said pumping;

d) storing said increased pressure liquid in said high pressure tank wherein said increased pressure liquid is pumped into an upper region of said high pressure tank via an upper feed line or a lower region of said high pressure tank via a lower feed line depending upon a pressure in said high pressure tank;

e) removing said increased pressure liquid from said high pressure tank in a state of thermodynamic disequilibrium between the liquid and gas phases;

f) feeding said increased pressure liquid from said low pressure tank to said high pressure tank when the mass of said carbon dioxide in said high pressure tank is less than about one quarter of a high pressure tank maximum capacity.

14. The method of claim 13, wherein said increased pressure liquid is fed to said high pressure tank when said mass is less than about one third of said capacity.

15. The method of claim 13, wherein said low pressure is less than about 40 bar.

16. A method which may be used for the uninterrupted supply of liquid subcooled carbon dioxide at a constant pressure greater than about 40 bar comprising:

a) supplying liquid carbon dioxide at low pressure;

b) introducing said low pressure liquid into a low pressure tank for temporary storage, said low pressure being less than 40 bar;

c) pumping said low pressure liquid, with a pump means, from said low pressure tank into a high pressure tank, wherein the pressure of said low pressure liquid is increased by said pumping;

d) storing said increased pressure liquid in said high pressure tank wherein said increased pressure liquid is pumped into an upper region of said high pressure tank via an upper feed line or a lower region of said high pressure tank via a lower feed line depending upon a pressure in said high pressure tank;

e) removing said increased pressure liquid from said high pressure tank in a state of thermodynamic disequilibrium between the liquid and gas phases; and f) providing said pump means with bubble-free liquid by recirculating any gaseous carbon dioxide, found in the line from said low pressure tank to said means, back to said low pressure tank.

17. A system used for the uninterrupted provision of subcooled carbon dioxide at a constant pressure greater than about 40 bar, comprising:

a) a low pressure tank containing carbon dioxide in liquid and gas phases;

b) a high pressure tank containing carbon dioxide in liquid and gas phases;

c) a pump located between said low pressure tank and said high pressure tank;

d) a first line connecting said low pressure tank to said pump;

e) a second line connecting said high pressure tank to said pump;

f) a second line valve in fluid communication between and with said second line and said high pressure tank;

g) an upper feed line in fluid communication between and with said second line valve and an upper region of said high pressure tank;

h) a lower feed line in fluid communication between and with said second line valve and a lower region of said high pressure tank;

i) a third line connecting a lower region of said high pressure tank with an upper region of said high pressure tank; and j) a first heater located on said third line.

18. A method which may be used for the uninterrupted supply of liquid subcooled carbon dioxide at essentially constant pressure greater than 40 bar comprising:

a) supplying liquid carbon dioxide at low pressure;

b) introducing said low pressure liquid into a low pressure tank for temporary storage, said low pressure being less than 40 bar;

c) pumping said low pressure liquid, with a pump means, from said low pressure tank into a high pressure tank, wherein the pressure of said liquid is increased by said pumping;

d) storing said increased pressure liquid in said high pressure tank and wherein said liquid is pumped into an upper region of said high pressure tank via an upper feed line or a lower region of said high pressure tank via a lower feed line depending upon a pressure in said high pressure tank;

e) removing said increased pressure liquid from said high pressure tank in a state of thermodynamic disequilibrium between the liquid and gas phases, wherein the temperature of the liquid phase in said high pressure tank is between about 0° C. and about 10° C.; and f) stabilizing the pressure in said high pressure tank by warming at least one member selected from the group consisting of the liquid phase of said high pressure tank and the gas phase of said high pressure tank.

19. A method which may be used for the uninterrupted supply of liquid subcooled carbon dioxide at a nearly constant pressure of greater than about 40 bar, the method comprising:

a) supplying liquid carbon dioxide at low pressure;

b) introducing said low pressure liquid into a low pressure tank for temporary storage, said low pressure being less than 40 bar;

c) pumping said low pressure liquid, with a pump means, from said low pressure tank into a high pressure tank, wherein the pressure of said liquid is increased by said pumping;

d) storing said increased pressure liquid in said high pressure tank, wherein said increased pressure liquid is pumped into an upper region of said high pressure tank via an upper feed line or a lower region of said high pressure tank via a lower feed line depending upon a pressure in said high pressure tank;

e) removing said increased pressure liquid from said high pressure tank in a state of thermodynamic disequilibrium between the liquid and gas phases; and f) stabilizing the pressure in said high pressure tank by warming at least one member selected from the group consisting of the liquid phase of said high pressure tank or the gas phase of said high pressure tank.

* * * * *